US008317422B2

(12) United States Patent
Schell

(10) Patent No.: US 8,317,422 B2
(45) Date of Patent: Nov. 27, 2012

(54) FLUID DISPENSER, PARTICULARLY FOR LIQUID SOAP

(75) Inventor: Guy Schell, Borgo (FR)

(73) Assignee: Societe Civile MGS (FR)

( * ) Notice: Subject to any disclaimer, the term of this patent is extended or adjusted under 35 U.S.C. 154(b) by 425 days.

(21) Appl. No.: 12/600,108

(22) PCT Filed: Apr. 15, 2008

(86) PCT No.: PCT/FR2008/000528

§ 371 (c)(1),
(2), (4) Date: Nov. 13, 2009

(87) PCT Pub. No.: WO2008/142296

PCT Pub. Date: Nov. 27, 2008

(65) Prior Publication Data

US 2010/0268134 A1 Oct. 21, 2010

(30) Foreign Application Priority Data

May 16, 2007 (FR) ..... 07 55113

(51) Int. Cl.
*A46B 11/00* (2006.01)

(52) U.S. Cl. ..... 401/28; 401/209; 401/214

(58) Field of Classification Search ..... 401/28, 401/208, 209, 214; 601/113, 129, 131
See application file for complete search history.

(56) References Cited

U.S. PATENT DOCUMENTS

| | | | | | |
|---|---|---|---|---|---|
| 3,406,657 | A | * | 10/1968 | Looper | 118/261 |
| 4,811,726 | A | * | 3/1989 | Goncalves et al. | 601/154 |
| 5,056,949 | A | * | 10/1991 | Petrillo | 401/214 |
| 5,125,757 | A | * | 6/1992 | Morrison et al. | 401/21 |
| 5,131,384 | A | * | 7/1992 | Obagi | 601/131 |

FOREIGN PATENT DOCUMENTS

| | | |
|---|---|---|
| DE | 250616 | 9/1912 |
| FR | 990.752 | 9/1951 |
| FR | 1.016.884 | 11/1952 |
| FR | 1.096.957 | 6/1955 |
| FR | 2 516 371 | 5/1983 |

* cited by examiner

*Primary Examiner* — David Walczak
(74) *Attorney, Agent, or Firm* — Gerald E. Hespos; Michael J. Porco

(57) ABSTRACT

A distributor (1) of fluid, particularly of liquid soap, has a sealed shell (2) suitable for containing the fluid to be distributed. The shell (2) has a shape and dimensions suitable for being able to be held between the hands of a user when the hands are being washed. Distribution mechanisms (30) are mounted movably on the shell (2) between a rest position in which they prevent the fluid from coming out of the shell and an active position in which they allow the fluid to come out when the user presses his hands against them during washing.

8 Claims, 5 Drawing Sheets

FLUID DISPENSER, PARTICULARLY FOR LIQUID SOAP

BACKGROUND OF THE INVENTION

1. Field of the Invention

The present invention relates to a liquid soap dispenser.

2. Description of the Related Art

There currently exist various ways for a person to wash himself, particularly his hands.

The first way is to use a solid dry soap such as a bar of soap that the person rubs between his hands after having preferably already run them under the water. Once the hands have been covered with suds, the person puts the bar of soap onto the ledge of a basin or into a suitable soap holder. In this case, the bar of soap thus often sits in a puddle of water which causes the soap to soften, thereby rapidly impairing its qualities. Pasty residues which are not very pleasing to the eye may also collect in the soap holder and stick to the bottom of the latter, requiring it to be cleaned frequently.

In addition, after the hands have been wetted and rubbed on the bar of the soap, the latter is very often covered with dirty suds. The bar of soap thus has a not very attractive appearance. From a hygiene point of view, the next person who will be washing his hands with the dirty bar of soap will partially be covered with this dirt. Microbes can also be transferred easily from one individual to another.

Finally, one of the main drawbacks of a bar of soap is that it wears down rapidly over time, dries out, and cracks. When it is below a certain size it becomes difficult or even impossible to use and is thus thrown away, which is not very economical.

The second way involves liquid soap dispensers which are portable or fixed on a wall in the immediate vicinity of the basin. These devices generally have a refillable vessel provided with a filling opening and a pump actuated by the person in order to dispense liquid soap. However, these pumps are often difficult to manipulate, especially with wet hands. When the pump is manipulated after the hands have been run under the water, dirt which has come unstuck during this operation (grease, earth, etc.) is deposited on the pump which is not very attractive or hygienic unless it is cleaned after each use.

This type of device is actuated by a pump which dispenses an uncontrollable amount of liquid soap and hence much more is used than is needed.

After use, the pouring spout of the pump often allows drops of liquid soap to escape, which drops spread out on the ledge of the basin requiring extra cleaning (rinsing and wiping).

Finally, refilling this type of device is sometimes tricky, unless the pump is retained and a new prefilled vessel is bought each time, this being very costly and not very ecological.

It is thus an object of the present invention to solve the above-mentioned problem with the aid of a solution which is easy to implement, is reliable and is inexpensive.

SUMMARY OF THE INVENTION

Thus, the subject of the present invention is a fluid dispenser, particularly for liquid soap, comprising a hermetic casing suitable for containing the fluid to be dispensed and provided with means for dispensing the fluid, characterized in that the casing has a form and dimensions such that it can be held between a user's hands while they are being washed, and in that the dispensing means are mounted on the casing such that they can move between a rest position in which they prevent the release of fluid from the casing and an active position in which they allow the release of fluid when the user presses his hands against them during the washing process.

According to various preferred embodiments, the dispenser according to the present invention may further comprise at least one of the following features:

- the casing is made of two parts connected together in a fluid-tight manner along a peripheral joint plane;
- the dispensing means are located on at least part of the casing and protrude locally from the external surface of the latter;
- the dispensing means comprise at least one closing element engaging tightly in an outlet orifice made in the wall of the casing, said closing element being able to move axially in order to pass from a state where it blocks the fluid into a state for dispensing the latter;
- the peripheral surface of the outlet orifice has a conical cross section narrowing from the inside toward the outside of the casing, the closing element having a complementary form such that fluid-tightness is provided in the blocking state;
- the closing element is mushroom shaped and has a shank located in the casing and extended axially by a head which, in the rest position of the closing off means, bears against the peripheral surface of the orifice, said shank being surrounded by a compression spring exerting an axial pressure on the head in order to press it against said peripheral surface;
- the casing contains a supporting plate provided with an opening which holds and axially guides the shank of each closing element;
- a ring is fastened under the plate, coaxially with the opening, in order to center the shank of the corresponding closing element;
- the dispenser comprises two tapped coaxial sockets protruding from the internal surface of each part of the casing, the supporting plate being immobilized between these sockets by way of a screw that can be accessed from outside the casing;
- one of the sockets is provided at its free end with protuberances for centering the supporting plate in engagement with recesses made in the surface of said socket;
- the supporting plate is cross shaped and is provided with an opening at the end of each arm of the cross;
- that part of the casing which is opposite the part provided with the outlet orifice has on its internal surface a hollow socket which holds and guides the shank of the closing element in a sliding manner, the compression spring being compressed between the free edge of the socket and the face of the head directed toward it;
- the closing element comprises a ball comprising a first part resting against the peripheral surface of the outlet orifice and a second part resting on a compression spring housed in a centered manner in a socket protruding from the internal surface of that part of the casing which is opposite the part provided with the outlet orifice, the spring exerting an axial pressure on the ball in order to press it against the peripheral surface of the outlet orifice;
- the second part of the ball rests on a hemispherical portion of a hollow piston surrounding the socket in a sliding manner and bearing against the spring which is guided axially by said socket;
- the bottom of the hemispherical portion is pierced by an orifice coaxial with the compression spring;

the ball is of dimensions suitable for performing a massaging function in combination with a liquid massage product contained in the casing;

the closing element forms a cylinder having a rounded head suitable for resting against the peripheral surface of the outlet orifice and a tubular part which holds one of the ends of a compression spring, the other end of which is held in a centered manner in a socket connected to the part of the casing opposite the part provided with the outlet orifice;

the tubular part of the closing element is mounted around the socket and guided axially by the latter;

the outlet orifice has a circular peripheral surface that makes an angle of around 45° with its axis of symmetry;

a first socket protrudes from the internal surface of the part of the casing provided with the dispensing means and has a free end part having a polygonal internal cross section and a part opposite the end part which is tapped and holds a screw for fastening the parts of the casing together;

a second socket protrudes from the internal surface of the other part of the casing, in the axis of the first socket, and has a free end part having a polygonal external cross section and engaging in a sliding manner with the end part of the first socket, while the fastening screw passes through the second socket;

the second socket has a housing opening on the outside of the casing and in which the head of the screw is held without protruding from the external surface of the corresponding part of the casing, the housing being closed off by a removable cap;

a filling orifice is located opposite the fluid dispensing means and is closed off by a removable sealing cap; and the dispenser is made of a cast or molded material selected from the group consisting of a metal, glass, a ceramic and a plastic, and has the form of a bar of soap.

The invention will now be described in more detail with reference to particular embodiments given solely by way of illustration and shown in the appended figures.

DETAILED DESCRIPTION OF THE PREFERRED EMBODIMENTS

Figure 1:
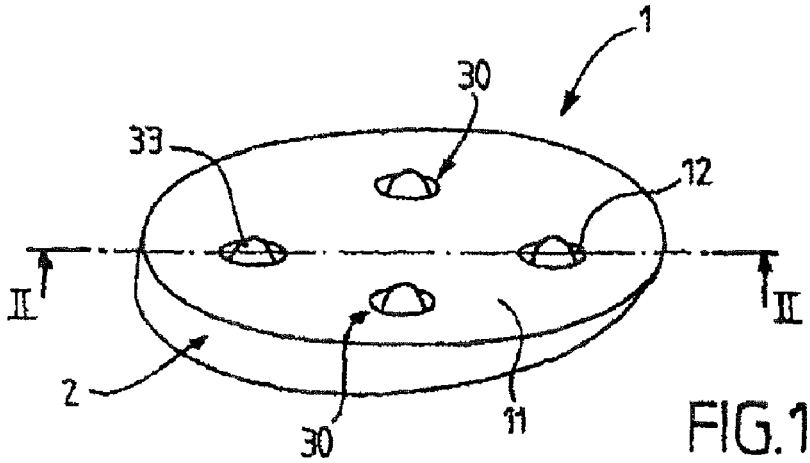
FIG. 1 is a perspective view of a dispenser according to the present invention.

FIG. 1 shows a liquid soap dispenser 1 for use, for example, in a bathroom, a kitchen or a toilet. This soap dispenser 1 has the form and dimensions of a bar of soap, which makes it easy to manipulate with the hands. Typically, it has the form of a cobble measuring around 5 to 10 centimeters long, 3 to 6 centimeters wide and 1 to 3 centimeters thick.

The soap dispenser 1 is produced from a cast or molded material selected from the group consisting of a metal, such as aluminum or stainless steel, glass, a ceramic and a plastic.

The dispenser 1 has a hermetic casing 2 suitable for containing the liquid soap to be dispensed. This casing 2 consists of two half shells 10 and 20 of substantially the same dimensions and joined together at a peripheral joint mid-plane 5.

Figure 2:
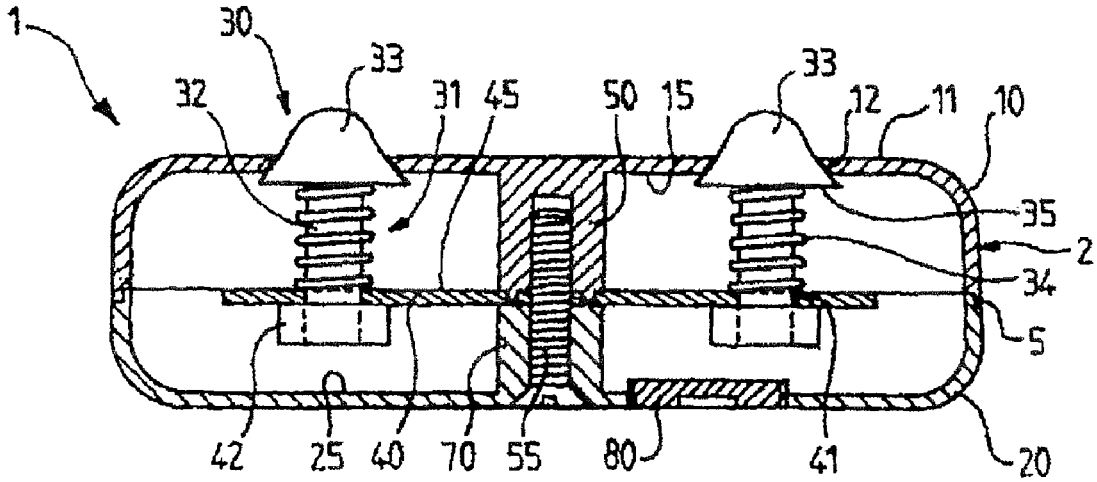
FIG. 2 is a cross-sectional view on the line II-II in FIG. 1 illustrating a first embodiment of the dispenser.
Figure 3:
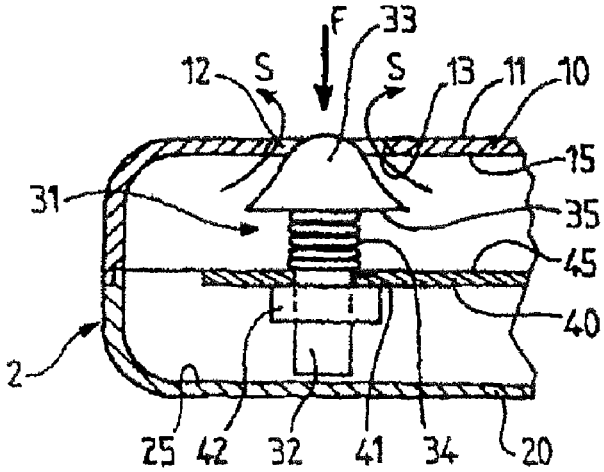
FIG. 3 is a detail view of FIG. 2 in a use position.
Figure 4:
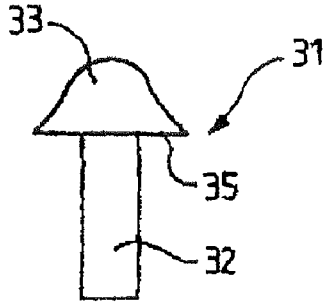
FIG. 4 is a detail view of a closing element.

As is also illustrated in FIGS. 2 and 3, the external surface 11 of the first half shell 10 has soap dispensing means 30. The soap dispensing means 30 are mounted on the first half shell 10 such that they can move between a rest position in which they prevent the release of fluid from the casing (FIG. 2) and an active position in which they allow the release of fluid when the user presses his hands against them during the washing process (FIG. 3).

More precisely, each soap dispensing means 30 has at least one closing element 31 engaging tightly in an outlet orifice 12 made through the wall of the first half shell 10.

According to a first embodiment illustrated in FIGS. 2 to 7, the closing element 31 is mushroom shaped and has a shank 32 located inside the casing 2 and extended axially by a head 33 bearing, in the rest position of the closing off means 30, against the peripheral surface 13 of the outlet orifice 12.

Figure 6:
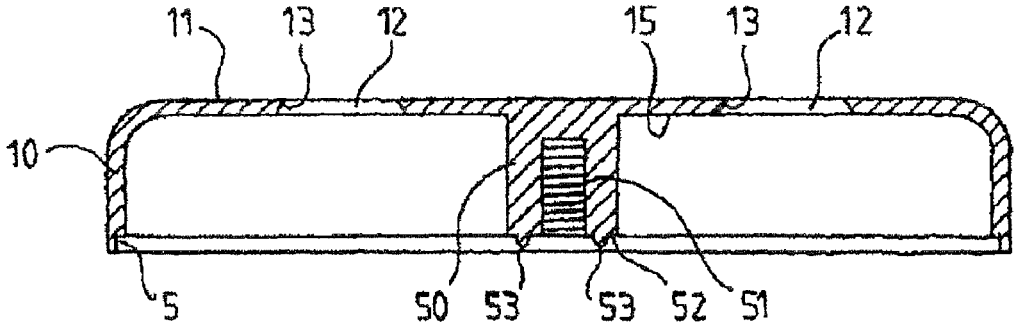
FIG. 6 is a cross-sectional view of a first part of the dispenser casing.

As can be seen in particular in FIGS. 3 and 6, the peripheral surface 13 of the outlet orifice 12 has a conical cross section narrowing from the inside toward the outside of the casing 2 while the closing element 30 has a complementary form such that fluid-tightness is provided in the blocking state. In the present case, the peripheral surface 13 makes an angle of around 45° with the axis of symmetry of the corresponding orifice 12.

Part of the head 33 protrudes locally a few millimeters from the external surface 11 of the first half shell 10 such that it can be actuated by a user's hands. The shank 32 is surrounded by a compression spring 34 exerting an axial pressure on the head 33 in order to press it against the peripheral surface 13 of the orifice 32, as illustrated in FIG. 2.

The casing 2 also contains a supporting plate 40 provided with an opening 41 which holds and axially guides the shank 32 of each closing element 31. A ring 42 is fastened under the plate, coaxially with the opening 41, in order to center the shank 32 of the corresponding closing element 31. Thus, when the shank 32 is displaced axially as a result of a force F exerted by the user's hands on the head 33 (see FIG. 3), the shank 32 slides within the opening 41 and into the ring 42 such that it does not tilt. This enables a suitable release of liquid soap along the arrows S in FIG. 3. The spring 34 rests firstly against a surface 35 of the head 33 facing the supporting plate 40 and secondly on a surface 45 of the supporting plate 40.

Figure 5:
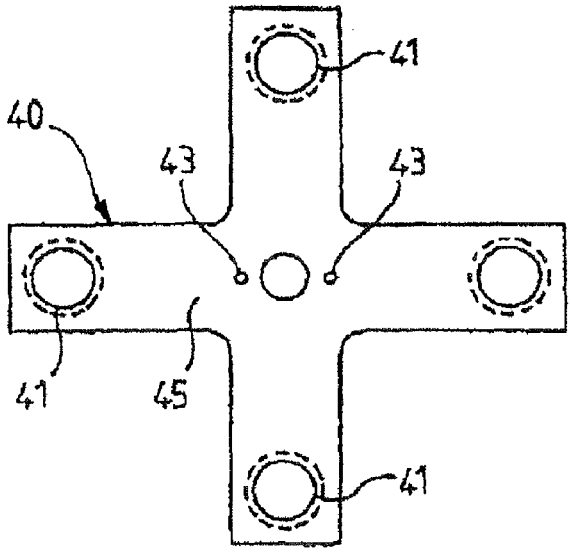
FIG. 5 is a top view of a closing element supporting plate.

FIG. 5 illustrates the distribution of the liquid soap dispensing means. Thus, the external surface 11 of the first half shell 10 is provided with four outlet orifices 12 distributed in the shape of a cross. The supporting plate 40 is itself cross shaped, each end of the arms having a through opening 41 coaxial with an outlet orifice 12.

FIG. 6 is a cross-sectional view of the first half shell 10, the internal surface 15 of which is provided with a central socket 50. This socket has internal thread 51 for holding a fastening screw 55 (FIG. 1) which is accessible from the outside of the casing and enables the two half shells 10 and 20 to be fastened together in a leaktight manner. The socket 50 also has, at its free end 52, two protuberances 53 engaging with recesses 43 provided on the supporting plate 40 (FIG. 5) in order to be able to center and hold said socket in position. The second shell 20 itself has another socket 70 protruding from its internal surface 25. The supporting plate 40 is clamped firmly between the sockets 50 and 70 and the latter are pushed toward one another by virtue of the fastening screw 55.

Figure 7:
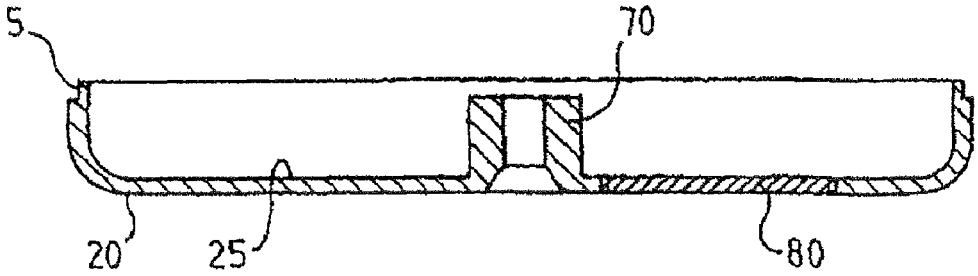
FIG. 7 is a cross-sectional view of the other part of the dispenser casing.

As can be seen in FIG. 7, a leaktight filling cap is provided on the second half shell 20 in order to be able to refill the liquid soap dispenser of the present invention.

Figure 8:
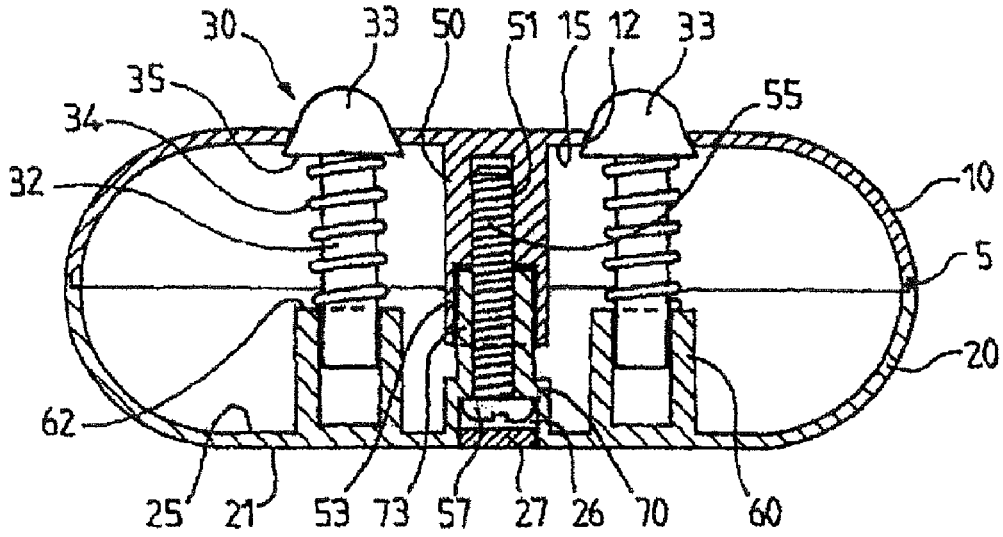
FIG. 8 is a cross-sectional view of a second embodiment of the dispenser according to the present invention.
Figure 9:
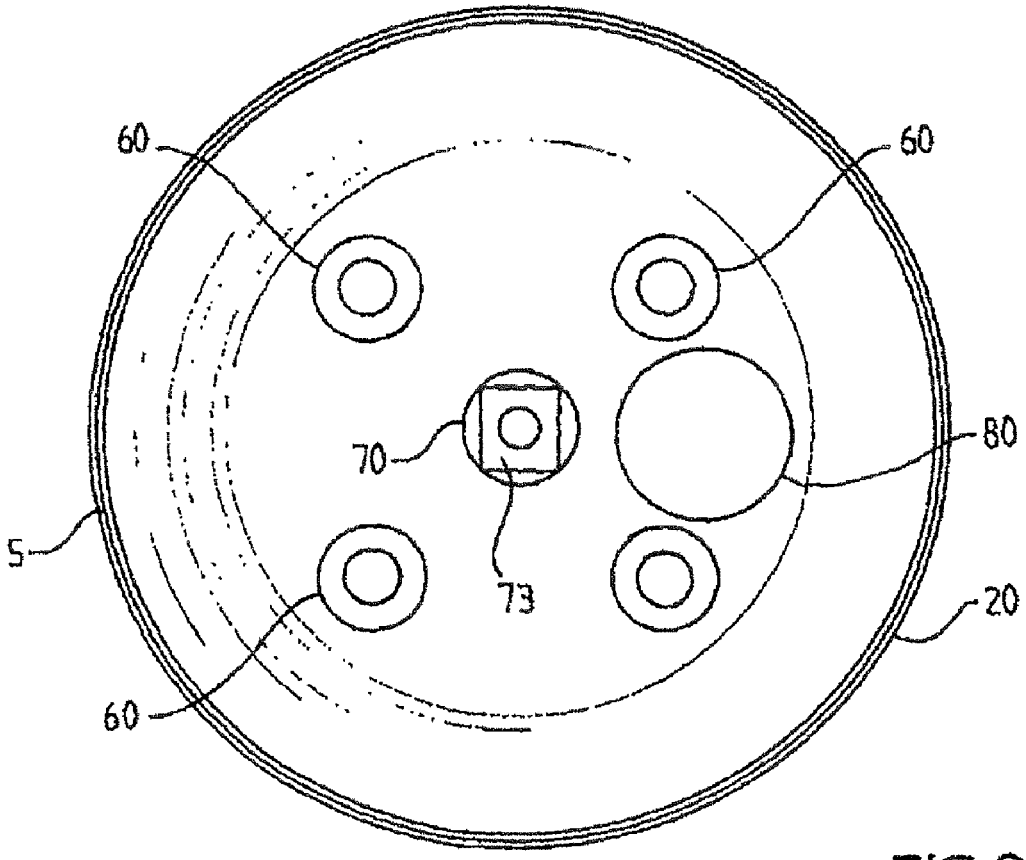
FIG. 9 is a front view of FIG. 8.
Figure 10:
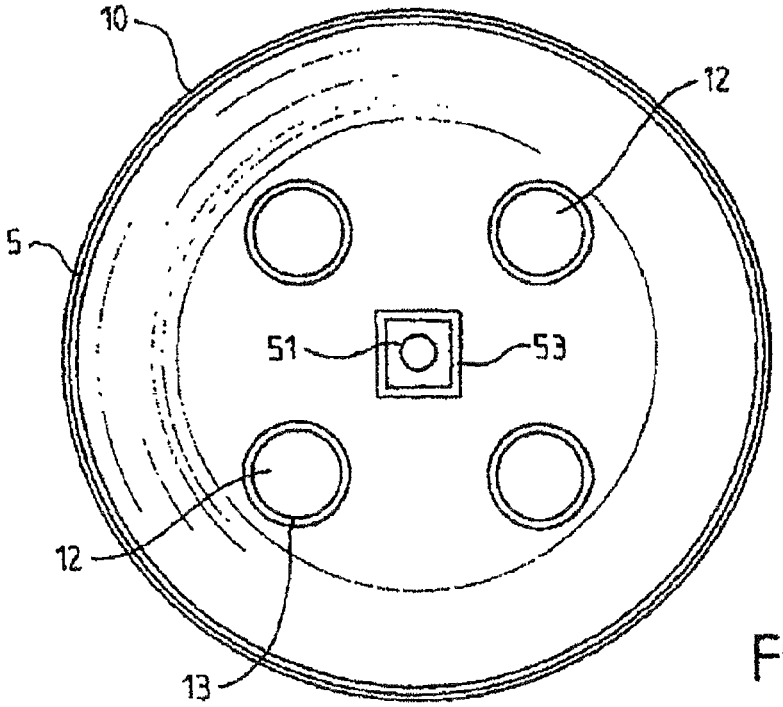
FIG. 10 is a bottom view of the dispenser.

In a variant illustrated in FIGS. 8 to 10, the shank 32 of each closing element 31 slides axially in a hollow socket 60 protruding from the internal surface 25 of the second half shell 20, inside the casing 2. The compression spring 34 is compressed between the free edge 62 of the socket 60 and the surface 35 of the head 33 facing the latter.

The internal surface 25 of the second half shell 20 also has a central socket 70 protruding inside the casing 2, coaxially with the socket 50 protruding from the internal surface 15 of the first half shell 10. The socket 50 has a free end part 53 have a polygonal internal cross section and a part 51 opposite the end part which is tapped in order to hold the fastening screw 55. The socket 70 has a free end part 73 having a polygonal external cross section engaging in a sliding manner with the end part 53 of the socket 50. The fastening screw passes all the way through the socket 70.

The external surface 21 of the second half shell 20 also has, continuing the socket 70, a housing 26 which opens onto the outside of the casing 2. The head 57 of the screw 55 is held in this housing 26 without protruding from the external surface 21 of the second half shell 20. The housing 26 is also closed off by a removable cap 27.

Figure 11:
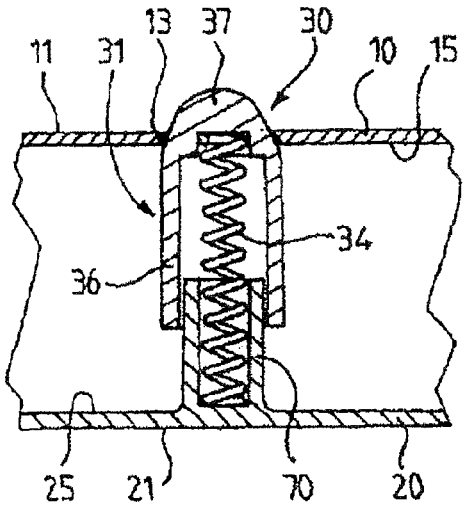
FIG. 11 is a detail view in cross section of a second embodiment of the closing element.

According to another embodiment illustrated in FIG. 11, the closing element 31 has the form of a cylinder having a rounded head 37, suitable for resting against the peripheral surface 13 of the outlet orifice 12, and a tubular part 36. The compression spring 34 is housed in the tubular part 36 and held in a centered manner in the socket 70 protruding from the internal surface 25 of the second half shell 20.

When the user's hands press on the head 37, the tubular part 36 slides axially along the socket 70 and the compression spring 34 is progressively compressed. Thus, an outlet passage for the liquid soap is formed between the head 36 of the closing element 31 and the peripheral surface 13 of the outlet orifice 12, as in the embodiment illustrated in FIG. 3.

Figure 12:
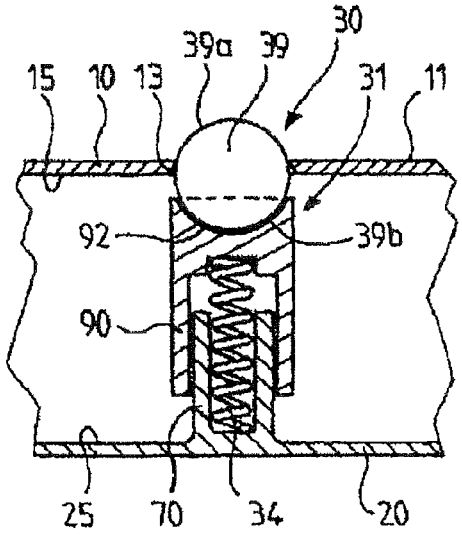
FIG. 12 is a detail view in cross section of a third embodiment of the closing element.

According to another embodiment of the closing element 31 illustrated in FIG. 12, the latter comprises a metal ball 39 having a first part 39*a* resting against the peripheral surface 13 of the outlet orifice 12 and a second part 39*b* resting on a hemispherical portion 92 of a hollow piston 90. The hollow piston 90 surrounds the socket 70 in a sliding manner, said socket 70 protruding from the internal surface 25 of the second half shell 20. It also rests on the compression spring 34 which is housed in a centered manner in the socket 70 and exerts an axial pressure on the ball 39 in order to press it against the peripheral surface 13 of the outlet orifice 12.

Thus, when the user's hands press against the ball 39, the latter is displaced axially into the casing 2 so as to form an outlet passage for the liquid soap. When the pressure is released, the return force of the compression spring 34 presses the ball 39 in a leaktight manner against the peripheral surface 13 of the outlet orifice 12 in order to close off the latter and prevent any escape of soap.

Advantageously, the ball 39 is of dimensions suitable for performing a massaging function on the body in combination with a liquid massage product contained in the casing 2.

Figure 13:
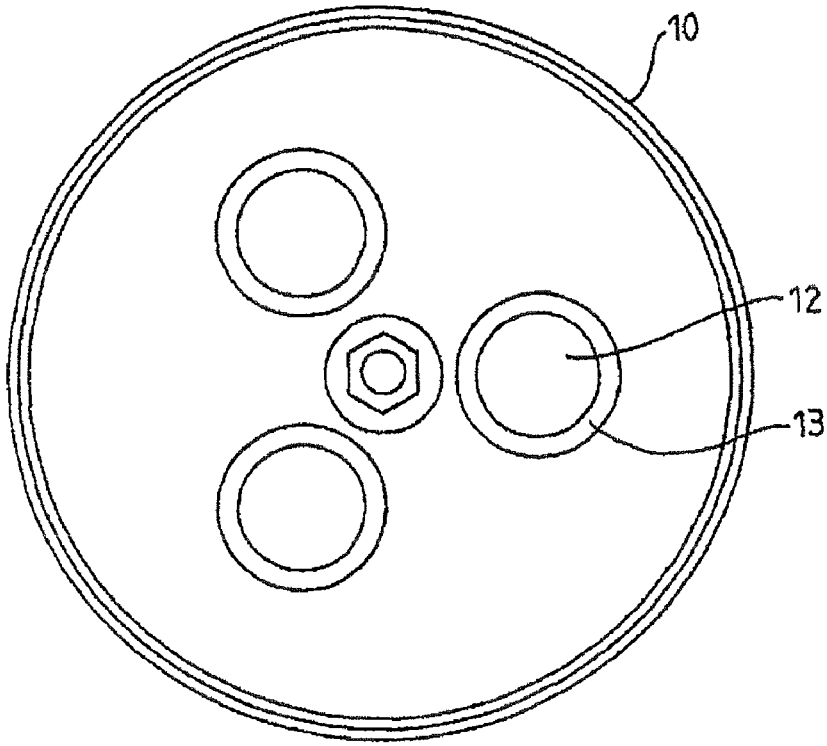
FIGS. 13 to 15 are an internal view along the arrow A, a cross-sectional view and a detail view of another variant of the present invention.
Figure 14:
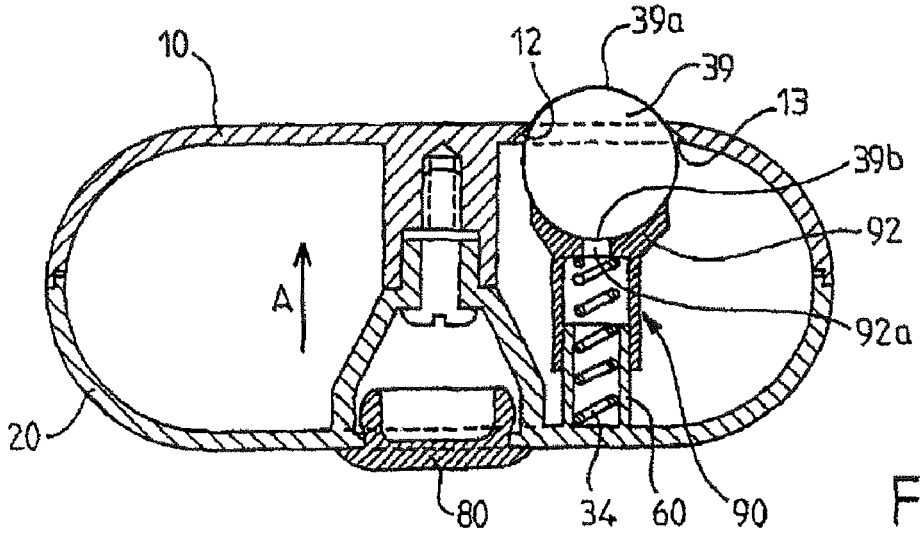
Figure 15:
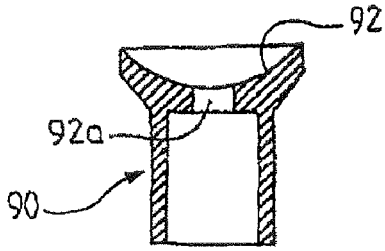

FIGS. 13 to 15 illustrate a variant of this embodiment. Specifically, as can be seen in FIG. 13 which is an internal view along the arrow A of the upper half shell 10, the dispenser 1 has the form of a puck of round cross section having three closing elements 31 arranged in a circle and angularly spaced regularly around a single circle, that is to say at 120° to one another. Each closing element 31 comprises a ball 39 having a first part 39*a* resting against the peripheral surface 13 of the outlet orifice 12 and protruding slightly from the external surface of the half shell 10, and a second part 39*b* resting on an upper hemispherical portion 92 of a hollow piston 90 which forms a seat.

The hollow piston 90 surrounds the socket 60 in a sliding manner, said socket protruding from the internal surface 25 of the second half shell 20. It also rests on the compression spring 34 which is housed in a centered manner in the socket 60 and exerts an axial pressure on the ball 39 in order to press it against the peripheral surface 13 of the outlet orifice 12.

The upper hemispherical portion 92 of the hollow piston 90 furthermore has a central orifice 92*a* coaxial with the spring 34 which enables the ball 39 to revolve about itself. This orifice 92*a* also enables the soap which may be present in the socket 60 to coat the ball when it rotates on the seat 92.

Thus, when the user's hands press on the balls 39 by rubbing, these balls are slightly displaced axially into the casing 2 so as to form an outlet passage for the liquid soap at the orifice 12. In addition, the ball 39 may rotate about itself while resting on the seat 92 and thus convey soap to its peripheral surface. When the pressure is released, the return force of the compression spring 34 presses the ball 39 in a leaktight manner against the peripheral surface 13 of the outlet orifice 12 in order to close off the latter and prevent any escape of soap.

The dispenser 1 according to this embodiment is also provided with a filling cap located at the center of the face opposite the face containing the closing elements 31.

It goes without saying that the detailed description of the subject of the invention, given purely by way of illustration, constitutes no limitation whatever and that technical equivalents are also included within the scope of the present invention.

Thus, the number of dispensing means 30 is not limited, nor is the distribution thereof on one half shell or on both half shells at once.

The form of the closing element may also vary as long as leaktightness can be ensured with the peripheral surface 13 of the outlet orifice.

The fastening screw for the two half shells can later be welded in place to prevent the latter from coming apart. Alternatively, it is also possible to weld the half shells directly together, for example at their joint plane, by a technique involving ultrasound, high frequency or friction.

The ball may be made from a variety of materials, for example molded plastic, metal or glass.

The invention claimed is:

1. A fluid dispenser (1), comprising:

a hermetic casing (2) suitable for containing the fluid to be dispensed, said casing comprising two parts (10, 20) connected together in a fluid-tight manner along a peripheral joint plane (5) and having a form and dimensions such that the casing can be held between a user's hands while the hands are being washed, at least one closing element (31) mounted on the casing (2) and being movable between a rest position in which the closing element (31) prevents a release of the fluid from the casing and an active position in which the closing element (31) allows the release of the fluid when the user presses his hands against the closing element (31) during washing, the closing element (31) being located on at least part (10; 20) of the casing (2) and protruding locally from an external surface (11; 21) of the casing (2), and the at least one closing element (31) engaging tightly in an outlet orifice (12) in a wall of the casing (2), said closing element (31) being movable axially from a state where the closing element (31) blocks the fluid to a state for dispensing the fluid, the outlet orifice (12) having a peripheral surface (13) with a conical cross section narrowing from an interior of the casing toward the external surface (11; 21) of the casing (2), the closing element (31) having a complementary form to the peripheral surface of the outlet orifice so that fluid-tightness is provided in the blocking state, the closing element (31) comprising a ball (39) with a first part (39*a*) resting against the peripheral surface (13) of the outlet orifice (12) and a second part (39*b*) resting on a hemispherical portion (92) of a hollow piston (90) with an orifice (92) extending through the hemispherical portion (92), the hollow piston (90) slidably surrounding a socket (60) protruding from an internal surface of the casing (2) opposite the outlet orifice (12), a compression spring (34) housed in a centered manner in the socket (60), the spring (34) exerting an axial pressure on the hollow piston (90) to press the ball (39) against the peripheral surface (13) of the outlet orifice (12).

2. The dispenser as claimed in claim 1, characterized in that the ball (39) is of dimensions suitable for performing a massaging function in combination with a liquid massage product contained in the casing (2).

3. The dispenser as claimed in claim 1, characterized in that the outlet orifice (12) has a circular peripheral surface that makes an angle of around 45° with its axis of symmetry.

4. A fluid dispenser, comprising:

a hermetic casing (2) suitable for containing the fluid to be dispensed, said casing comprising first and second parts (10, 20) connected together in a fluid-tight manner along a peripheral joint plane (5) and having a form and dimensions such that the casing can be held between a user's hands while the hands are being washed, at least one closing element (31) mounted on the casing (2) and being movable between a rest position in which the closing element (31) prevents a release of the fluid from the casing and an active position in which the closing element (31) allows the release of the fluid when the user presses his hands against the closing element during washing, the closing element (31) being located on at least part (10; 20) of the casing (2) and protruding locally from an external surface (11; 21) of the casing (2), and the at least one closing element (31) engaging tightly in an outlet orifice (12) in a wall of the first part (10) of the casing (2), said closing element (31) being movable axially from a state where the closing element (31) blocks the fluid to a state for dispensing the fluid, the outlet orifice (12) having a peripheral surface (13) with a conical cross section narrowing from an interior of the casing toward the external surface (11; 21) of the casing (2), the closing element (31) having a complementary form to the peripheral surface of the outlet orifice so that fluid-tightness is provided in the blocking state, the closing element (31) comprising a ball (39) with a first part (39*a*) resting against the peripheral surface (13) of the outlet orifice (12) and a second part (39*b*) substantially aligned with a compression spring (34) housed in a centered manner in a socket (60) protruding from an internal surface (25) of the second part (20) of the casing (2) opposite the outlet orifice (12), the spring (34) exerting an axial pressure that urges the ball (39) against the peripheral surface (13) of the outlet orifice (12), a first socket (50) protruding from an internal surface (15) of first part (10) of the casing, the first socket (50) having a free end part (53) with a polygonal internal cross section and a part opposite the end part which is tapped and holds a screw (55) for fastening the parts of the casing together.

5. The dispenser as claimed in claim 4, characterized in that a second socket (70) protrudes from the internal surface (25) of the second part (20) of the casing coaxially with the first socket (50), and has a free end part (73) having a polygonal external cross section and engaging in a sliding manner with the end part (53) of the first socket (50), while the fastening screw (55) passes through the second socket (70).

6. The dispenser as claimed in claim 5, characterized in that the second socket (70) has a housing (26) opening on the outside of the casing (2) and in which a head (57) of the screw (55) is held without protruding from the external surface (21) of the second part (20) of the casing, the housing (26) being closed off by a removable cap (27).

7. The dispenser as claimed in claim 1, characterized in that a filling orifice is located in a part (20) of the casing (2) substantially opposite the part (10) of the casing (2) that has the outlet orifice (12) and is closed off by a removable sealing cap (80).

8. The dispenser as claimed in claim 1, characterized in that the casing (2) is made of a cast or molded material selected from the group consisting of a metal, glass, a ceramic and a plastic, and has a form of a bar of soap.

* * * * *